US009417004B2

(12) United States Patent
Kim et al.

(10) Patent No.: US 9,417,004 B2
(45) Date of Patent: Aug. 16, 2016

(54) REFRIGERATOR AND METHOD FOR OPENING/CLOSING DOOR THEREOF

(71) Applicant: LG Electronics Inc., Seoul (KR)

(72) Inventors: Sanghun Kim, Seoul (KR); Seonkyu Kim, Seoul (KR); Minsup Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 625 days.

(21) Appl. No.: 13/864,400

(22) Filed: Apr. 17, 2013

(65) Prior Publication Data

US 2013/0276474 A1 Oct. 24, 2013

(30) Foreign Application Priority Data

Apr. 18, 2012 (KR) ..... 10-2012-0040523

(51) Int. Cl.

| | |
|---|---|
| ***F25D 25/00*** | (2006.01) |
| ***F25D 23/02*** | (2006.01) |
| ***F25D 19/00*** | (2006.01) |
| ***F25D 11/00*** | (2006.01) |
| ***F25D 23/04*** | (2006.01) |
| ***E05B 65/00*** | (2006.01) |

(Continued)

(52) U.S. Cl.

CPC ..... *F25D 11/00* (2013.01); *E05B 65/0042* (2013.01); *E05C 17/025* (2013.01); *F25D 23/028* (2013.01); *F25D 23/04* (2013.01); *F25D 29/006* (2013.01); *F25D 2323/024* (2013.01)

(58) Field of Classification Search

CPC ..... F25D 23/02; F25D 23/028; F25D 23/04; F25D 11/00; F25D 2323/024; E05B 65/0042; E05B 65/005; Y10S 292/17; Y10S 292/71

USPC ..... 62/377, 265, 449; 312/321.5, 138.1, 312/405, 216; 292/137, 138, 145, DIG. 71; 70/78, 79, 81, 101, 102

See application file for complete search history.

(56) References Cited

U.S. PATENT DOCUMENTS

| | | | | |
|---|---|---|---|---|
| 2,459,190 | A | 1/1949 | Shuart | |
| 4,084,866 | A | 4/1978 | Hayashi | |
| 4,503,582 | A * | 3/1985 | Gurubatham | 16/232 |

(Continued)

FOREIGN PATENT DOCUMENTS

| | | | |
|---|---|---|---|
| CN | 101504240 | A | 8/2009 |
| JP | S 48-54359 | U | 7/1973 |

(Continued)

OTHER PUBLICATIONS

European Search Report dated May 18, 2015 for European Application No. 13164085.6, 6 Pages.

*Primary Examiner* — Cassey D Bauer
*Assistant Examiner* — Joseph Trpisovsky
(74) *Attorney, Agent, or Firm* — Fish & Richardson P.C.

(57) ABSTRACT

A refrigerator includes a main body, a storage room defined in the main body, and a cooling device configured to cool the storage room. The refrigerator also includes a door rotatably connected to the main body and configured to open and close the storage room. The refrigerator also includes a door storage mounted to the door and having a side storage portion that is accessible when the door is open to an acute opening angle. In addition, the refrigerator includes a door locking mechanism configured to selectively lock the door at the acute opening angle at which the side storage portion is exposed between the main body and the door.

14 Claims, 7 Drawing Sheets

(51) Int. Cl.
*E05C 17/00* (2006.01)
*F25D 29/00* (2006.01)

(56) References Cited

U.S. PATENT DOCUMENTS

2004/0093799 A1* 5/2004 Yoshikawa et al. ..... 49/192
2006/0043852 A1* 3/2006 Kwon ..... 312/405
2009/0009043 A1* 1/2009 Gwak ..... 312/405.1
2011/0074261 A1* 3/2011 Assmann et al. ..... 312/326

FOREIGN PATENT DOCUMENTS

JP S 50-53766 U 5/1975
JP S 59-26587 U 2/1984
WO WO 91/02934 3/1991

* cited by examiner

REFRIGERATOR AND METHOD FOR OPENING/CLOSING DOOR THEREOF

CROSS-REFERENCE TO RELATED APPLICATION

This application claims priority from Korean Application No. 10-2012-0040523, filed Apr. 18, 2012, the subject matter of which is incorporated herein by reference.

FIELD

The present disclosure relates to a refrigerator and a method for opening/closing a door thereof.

BACKGROUND

In general, a refrigerator is an apparatus which cools a storage room, such as a cold room or freezer, using a refrigeration cycle circuit having a compressor, a condenser, an expansion device and evaporator, a thermo-module, etc., and keeps storage products, such as foods, in the storage room.

A door for opening/closing the storage room is mounted to the refrigerator, and a storage, such as a shelf or basket, in which storage products are kept, can be disposed inside the storage room or at the door.

Recently, a refrigerator has been developed, in which a home bar door is mounted in a door for opening/closing a storage room, and a home bar storage enabling storage products to be kept therein is mounted at a rear position of the home bar door in the door, so that storage products can be inserted/extracted into/from the home bar storage by opening the home bar door without opening the door.

SUMMARY

In one aspect, a refrigerator includes a main body, a storage room defined in the main body, and a cooling device configured to cool the storage room. The refrigerator also includes a door rotatably connected to the main body and configured to open and close the storage room. The refrigerator further includes a door storage unit mounted to the door and having a side storage portion that is accessible when the door is open to an acute opening angle. In addition, the refrigerator includes a door locking mechanism configured to selectively lock the door at the acute opening angle at which the side storage portion is exposed between the main body and the door.

Implementations may include one or more of the following features. For example, the side storage portion may be an opening in the door storage unit that extends in a lateral direction of the door. The side storage portion may be located at a side of the door storage unit. The side storage portion may be located at a side of the door storage unit, which is furthest from a rotational center of the door.

In addition, the side storage portion may have an inner wall and, when the door is closed, a gap may enable air from the storage room to enter the side storage portion past the inner wall. The side storage portion may have an opening at a first side and may be blocked at a second side opposite to the first side. The door storage unit may extend in the vertical direction.

Further, the door storage unit may include multiple side storage portions. The acute opening angle may be within a range from 10 to 30 degrees. The acute opening angle may be an opening angle at which the side storage portion is entirely exposed. The acute opening angle may correspond to a lateral width of the side storage portion.

In some implementations, the refrigerator may include a door manipulation portion configured to manipulate a locking mode of the door locking mechanism. In these implementations, the door locking mechanism may include a moving locking member mounted in the door and configured to move upward and downward, a door latch mounted in the door, configured to latch the moving locking member based on the moving locking member being moved downward to a descended position, and configured to release the moving locking member based on the moving locking member being moved upward to an ascended position, and a locking member holder having a holding groove portion. Also, in these implementations, the locking moving member may be configured to insert into the holding groove portion and be held to the door latch based on the door being rotated to the acute opening angle. Further, in these implementations, the refrigerator may include a connecting member that is linked with the door manipulation portion, that is connected to the door latch, and that is configured to release the door latch from the moving locking member.

In some examples, the refrigerator may include a maintaining mechanism configured to maintain a closed state of the door and release the closed state of the door and a manipulation member that is linked with the door manipulation portion and configured to release the closed state of the door maintained by the maintaining mechanism based on the door manipulation portion being manipulated. In these examples, the refrigerator may include an auxiliary manipulation portion mounted in the door and an auxiliary manipulation member that is linked with the auxiliary manipulation portion and that is configured to release the closed state of the door maintained by the maintaining mechanism based on the auxiliary manipulation portion being manipulated.

In another aspect, a refrigerator includes a main body, a storage room defined in the main body, and a cooling device configured to cool the storage room. The refrigerator also includes a door rotatably connected to the main body and configured to open and close the storage room. The refrigerator further includes a door storage unit mounted to the door and having a side storage portion that is accessible when the door is open to an acute opening angle. In addition, the refrigerator includes a maintaining mechanism configured to maintain a closed state of the door and release the closed state of the door and a manipulation mechanism configured to manipulate the maintaining mechanism. The manipulation mechanism is configured to selectively lock the door based on the door being rotated to the acute opening angle at which the side storage portion is exposed between the main body and the door.

In yet another aspect, a method for opening a door of a refrigerator includes enabling opening of a door of a refrigerator to an acute opening angle at which a side storage portion of a door storage unit mounted to the door is exposed between a main body of the refrigerator and the door. The method also includes locking the door at the acute opening angle to maintain an opening state of the side storage portion. The method further includes releasing the locking of the door after the opening state of the side storage portion has been maintained and enabling rotation of the door to an opening angle greater than the acute opening angle after the releasing of the locking of the door.

Implementations may include one or more of the following features. For example, the method may include enabling opening of the door of the refrigerator to the acute opening angle based on a user manipulating a door manipulation portion. The method may include releasing the locking of the door when the door is closed.

DETAILED DESCRIPTION

Figure 1:
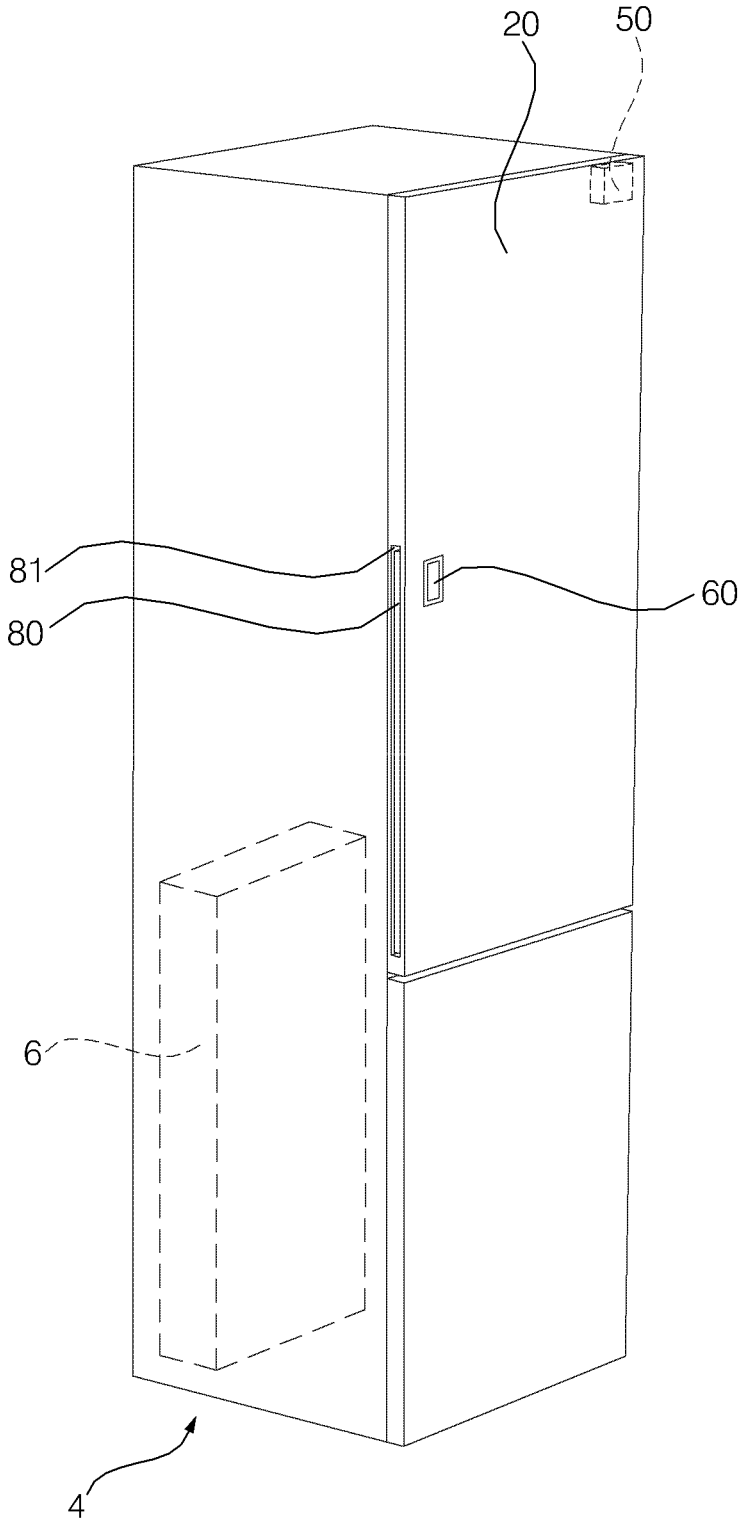
FIG. 1 is a perspective view of an example refrigerator when a door is closed.
Figure 2:
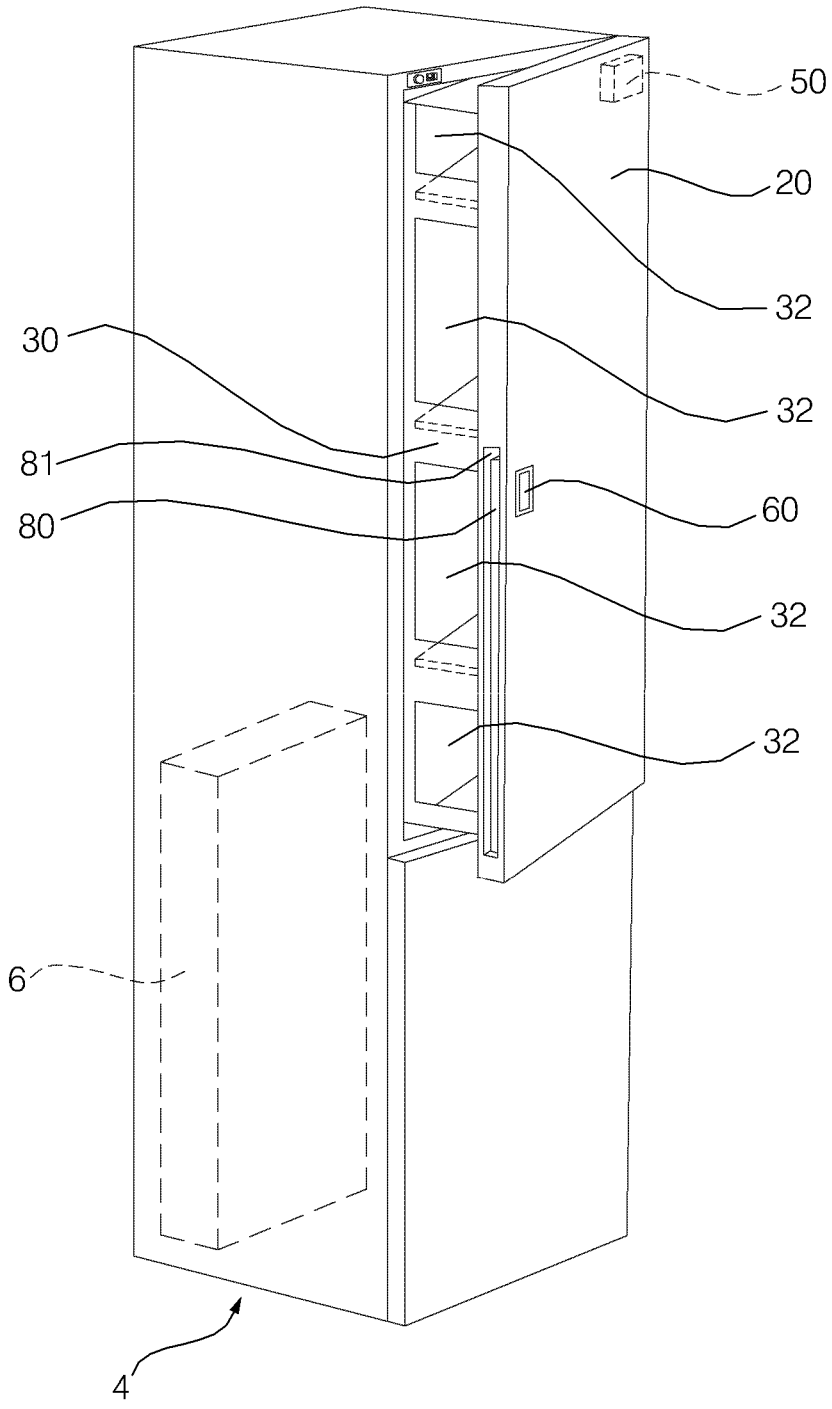
FIG. 2 is a perspective view of the example refrigerator when the door is opened with an acute opening angle at which a side storage product entrance/exit portion is exposed.
Figure 3:
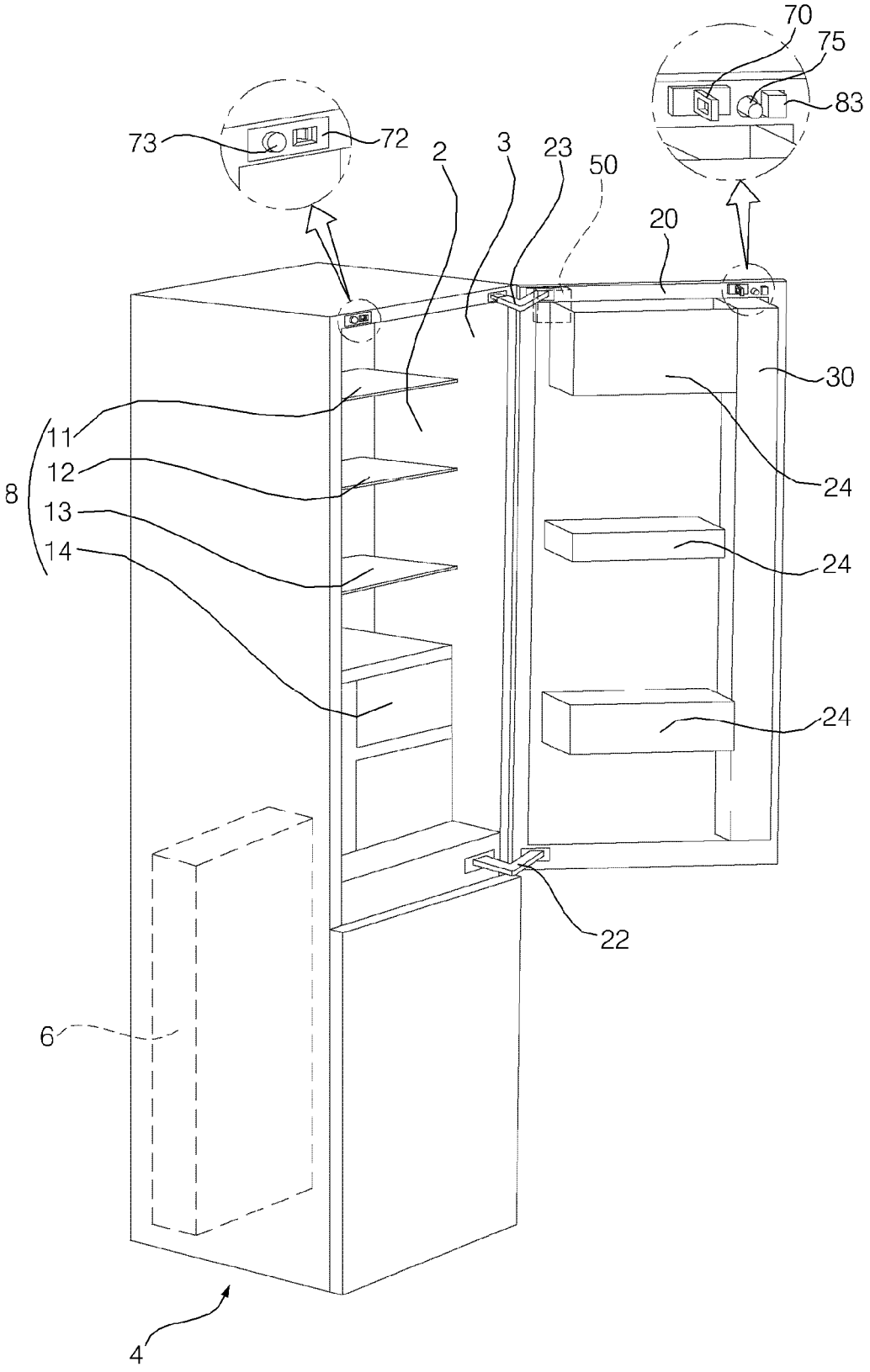
FIG. 3 is a perspective view of the example refrigerator when the door is opened with an opening angle greater than the acute opening angle.
Figure 4:
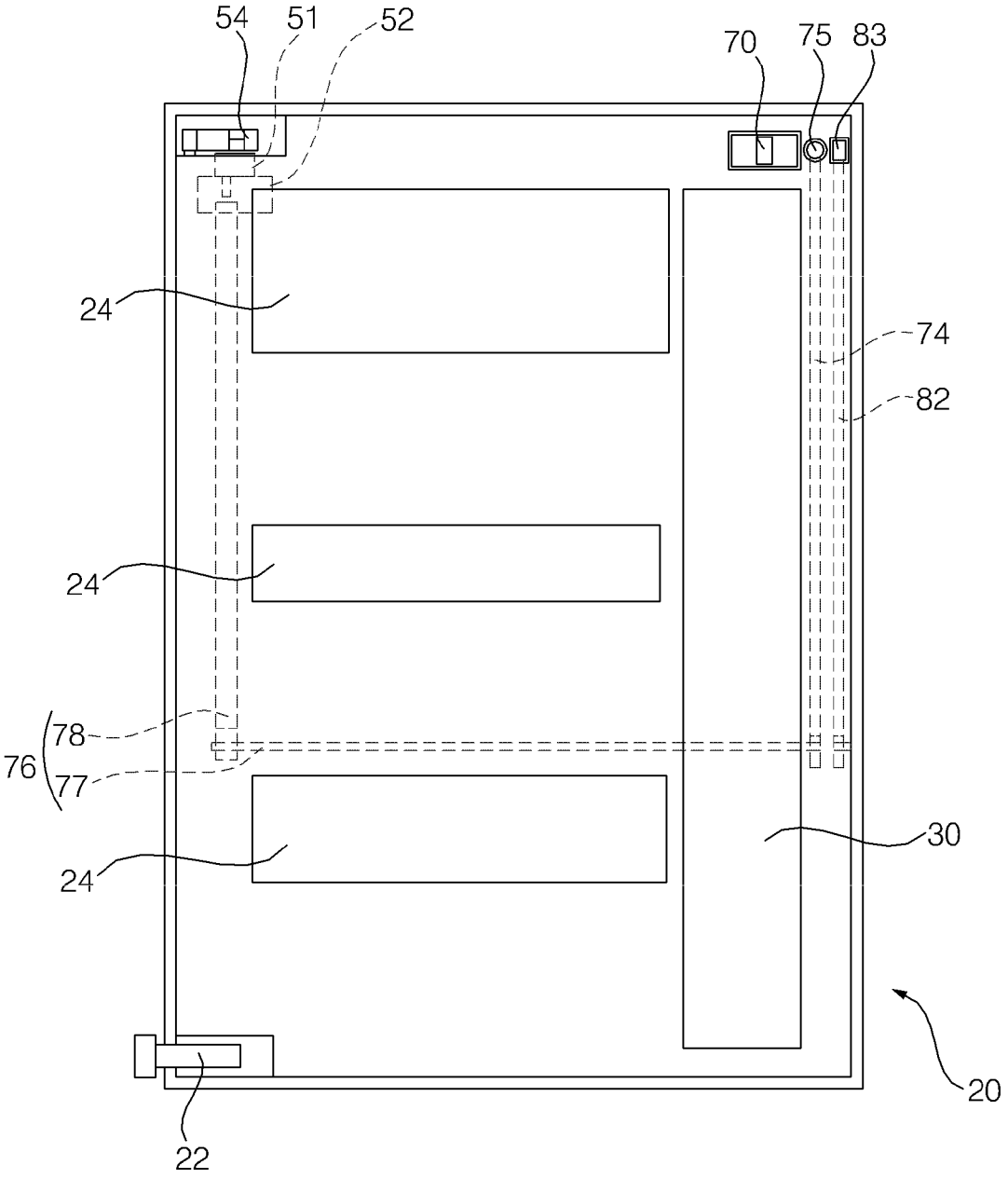
FIG. 4 is a rear view illustrating the door of the example refrigerator.
Figure 5:
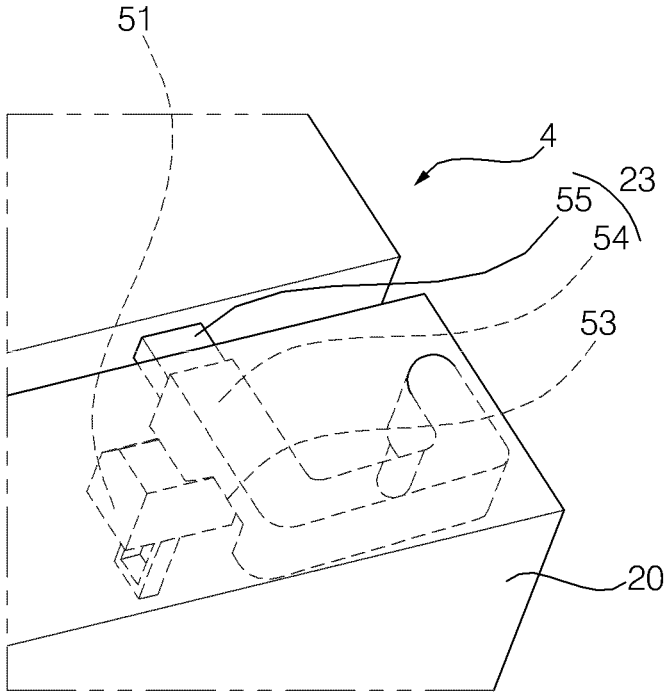
FIG. 5 is a perspective view illustrating an example door locking mechanism when the door is closed in the example refrigerator.
Figure 6:
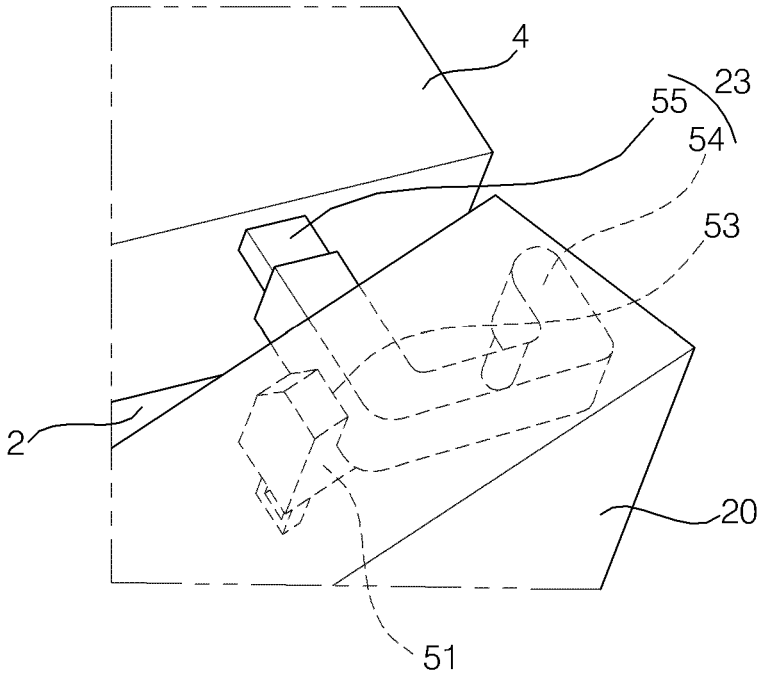
FIG. 6 is a perspective view illustrating the example door locking mechanism when the door is maintained at an acute opening angle in the example refrigerator.

FIG. 1 illustrates an example refrigerator when a door is closed. FIG. 2 illustrates the example refrigerator when the door is opened with an acute opening angle at which a side storage product entrance/exit portion is exposed. FIG. 3 illustrates the example refrigerator when the door is opened with an opening angle greater than the acute opening angle. FIG. 4 illustrates the door in the example refrigerator. FIG. 5 illustrates an example door locking mechanism when the door is closed in the example refrigerator. FIG. 6 illustrates the example door locking mechanism when the door is maintained at an acute opening angle in the example refrigerator.

The refrigerator shown in FIGS. 1-3 includes a main body 4 having a storage room 2 formed therein, a cooling device 6 cooling the storage room 2, a door 20 rotatably connected to the main body 4 so as to open/close the storage room 2, and a door storage 30 mounted to the door 20.

The storage room 2 can have an opened front surface 3. The storage room 2 may have an approximately hexahedral space. The main body 4 can have a machine room that is partitioned from the storage room 2. A storage 8 in which storage products can be kept separately from the door storage 30 can be disposed in the storage room 2. The storage 8 of the storage room 2 can include one or more shelves 11, 12 and 13 arranged in the storage room 8. The one or more shelves 11, 12 and 13 can partition the inside of the storage room 3 into a plurality of storage spaces. The one or more shelves 11, 12 and 13 can be arranged to be vertically spaced apart from one another. The one or more shelves 11, 12 and 13 can be mounted so that their positions are fixed inside the storage room 2, or can be mounted so that their heights are adjustable. The storage 8 of the storage room 2 can include at least one drawer 14 slidingly attached/detached to/from the storage room 2.

The cooling device 6 can include a refrigeration cycle circuit or thermo-module. The cooling device 6 can include a compressor compressing a refrigerant, a condenser condensing the refrigerant compressed in the compressor, an expansion mechanism expanding the refrigerant condensed in the condenser, and an evaporator evaporating the refrigerant expanded by the expansion mechanism. The compressor and the condenser can be mounted in the machine room formed in the main body 4. The evaporator can be mounted in the storage room 2, or can be mounted in a cooling room that communicates with the storage room 2. The cooling device 6 can include an evaporator fan allowing air in the storage room 2 to be circulated to the storage room 2 and the evaporator. The air sent to the evaporator by the evaporator fan can be heat-exchanged with the refrigerant and then sent to the storage room 2. The evaporator can be mounted to the outer wall of an inner casing of the storage room 2 so as to receive heat of the storage room 2 provided through the inner casing and to heat-exchange the received heat with the refrigerant. The cooling device 6 can include a condenser fan allowing air from the outside of the refrigerator to be sent to the condenser. The air sent to the condenser by the condenser fan can be heat-exchanged with the refrigerant and then exhausted to the outside of the refrigerator.

The door 20 can be mounted to be rotated about one of the left and right sides of the main body 4. The door 20 can be connected so that one of the left and right sides of the door 20 is rotatable by hinge members 22 and 23. The lower hinge member 22 can be connected to a lower portion of the door 20, and the upper hinge member 23 can be connected to an upper portion of the door 20. The door 20 can be adhered closely to a front surface of the main body 4 when the storage room 2 is closed. The door 20 can have a maximum opening angle (i.e., a maximum rotational angle at which the door 20 can be rotated about the front surface 3 of the storage room 2) of 90 degrees or more. The maximum opening angle of the door 20 can be an obtuse opening angle of 90 to 180 degrees, or can be an opening angle which exceeds 180 degrees. When the door 20 is rotated to an acute opening angle, a side storage product entrance/exit portion 32 can be exposed to the outside between the door 20 and the main body 4. The door 20 can be rotated up to the position where the side storage product entrance/exit portion 32 is exposed between the door 20 and the main body 4 and then fixed. The refrigerator can include a door manipulation mechanism enabling a user to manipulate the position of the door 20. When the user manipulates the door 20, the door manipulation mechanism enables the door 20 to be fixed at the position where the side storage product entrance/exit portion 32 exposed through the door 20 and main body 4. When the door manipulation mechanism is not manipulated, the door 20 is not fixed at the position where just the side storage product entrance/exit portion 32 is exposed through the door 20 and main body 4, but can be rotated up to the maximum opening angle. The door manipulation mechanism enables the door 20 to be rotated to the acute opening angle at which storage products can be entered/exited between the main body 4 and the door 20. The door manipulation mechanism can lock the door 20 at the acute opening angle of the door 20, at which the side storage product entrance/exit portion 32 of the door storage 30 is exposed between the main body 4 and the door 20. Here, the acute opening angle may be set to an opening angle at which the storage products can be accessed through the side storage product entrance/exit portion 32 of the door storage 30. Leakage of cooling air through the gap between the door 20 and the main body 4 may be reduced by the door 20 being open only to the acute opening angle. The acute opening angle may be an opening angle at which the side storage product entrance/exit portion 32 of the door storage 30 can be entirely exposed when the door 20 is opened. The acute opening angle can be set to increase as the lateral width of the side storage product entrance/exit portion 32 increases. The acute opening angle can be set to decrease as the lateral width of the side storage product entrance/exit portion 32 decreases. The acute opening angle of the door 20, which may be locked by the door manipulation mechanism, can be set in proportion to the lateral width of the side storage product entrance/exit portion 32. The acute opening angle of the door 20, which may be locked by the door manipulation mechanism, can be set to one of 10 to 30 degrees.

The refrigerator can include a door locking mechanism 50. The door locking mechanism 50 can be a partial component of the door manipulation mechanism. The door locking mechanism 50 can lock the door 20 or release the locking of the door when the door 20 is rotated to the acute opening angle at which the side storage product entrance/exit portion 32 is exposed between the door 20 and the main body 4. The door 20 can be locked by the door locking mechanism 50 at the acute opening angle where the side storage product entrance/exit portion 32 is exposed between the door 20 and the main body 4 so that the position of the door is fixed. When the door 20 is not locked by the door locking mechanism 50 at the acute opening angle where the side storage product entrance/exit portion 32 is exposed between the door 20 and the main body 4, the door 20 may be rotated up to the maximum opening angle. That is, when the door 20 is positioned at the acute opening angle where the side storage product entrance/exit portion 32 is exposed between the door 20 and the main body 4, the door locking mechanism 50 can selectively lock the door 20 or release the locking of the door 20. The door 20 can be rotated in a first rotation region from the position at which the storage room 2 is closed to the position at which the door locking mechanism 50 can lock the door 20. The door 20 can be rotated in a second rotation region from the position at which the door locking mechanism 50 can lock the door 20 to the position at which the door 20 is maximally opened. If the user rotates the door 20 in one direction while holding the door 20, the door 20 can be opened while being rotated to the second rotation region by passing through the first rotation region. If the user rotates the door 20 in the opposite direction while holding the door 20, the door 20 can be closed after passing through the first rotation region from the second rotation region. The door 20 can be rotated up to the position at which the door 20 can be locked by the door locking mechanism 50 from the position at which the storage room 2 is closed. The door 20 can be rotated to the maximum opening angle from the position at which the storage room 2 is closed.

The refrigerator can include a door manipulation portion 60 manipulating a locking mode of the door locking mechanism 50. The door manipulation portion 60 can be mounted in the door 20. The door manipulation portion 60 can be mounted to be pressed, pulled or rotated. If the user manipulates the door manipulation portion 60, the door locking mechanism 50 can be interlocked with the door manipulation portion 60 so as to be changed into the locking mode in which the door 20 is locked. If the user manipulates the door manipulation portion 60, the door 20 can be rotated in the direction where the storage room 2 is opened. The door 20 can be locked by the locking mode of the door locking mechanism 50 at the acute opening angle where the side storage product entrance/exit portion 32 is exposed between the main body 4 and the door 20.

In addition to the door storage 30, a sub-storage 24 can be mounted to the door 20. The sub-storage 24 can be a storage having a storage product entrance/exit direction different from that of the door storage 30. The sub-storage 24 and the door storage 30 can be mounted to the rear surface of the door 20. The sub-storage 24 and the door storage 30 can be mounted to the door 20 so that their heights or positions are adjustable. The sub-storage 24 and the door storage 30 can be slid along a sliding guide arranged along the lateral direction on the rear surface of the door 20.

The sub-storage 24 is not exposed when the door 20 is rotated to the acute opening angle by the door manipulation mechanism. The sub-storage 24 can be disposed along the lateral direction on the rear surface of the door 20. The sub-storage 24 can be a vertical entrance/exit type storage through which storage products can enter/exit in the vertical direction. The sub-storage 24 has a side storage product entrance/exit portion at an upper surface thereof. The sub-storage 24 can be arranged in plural numbers to be spaced apart from one another on the rear surface of the door 20. The sub-storage 24 can be mounted closer to the rotational center of the door 20 than the door storage 30. The sub-storage 24 can be covered by the door storage 30 when the door 20 is rotated at the acute opening angle by the door manipulation mechanism, and cannot be exposed through the gap between a side end of the door 20 and the main body 4. In a case where the door storage 30 is moved in the lateral direction, the sub-storage 24 can be moved in the lateral direction by the door storage 30.

The door storage 30 enables the side storage product entrance/exit portion 32 to be exposed between the door 20 and the main body 4 when the door 20 is locked by the door locking mechanism 50. The side storage product entrance/exit portion 32 can be an opening opened in the lateral direction in the door storage 30. Products can be inserted into the door storage 30 through the side storage product entrance/exit portion 32 at a side position, front side position or front position of the door storage 30. The products can be extracted to the side position, front side position or front position of the door storage 30 through the side storage product entrance/exit portion 32 from the door storage 30. For example, the storage products are inserted into the door storage 30 at the side of the side storage product entrance/exit portion 32, based on the door storage 30, and are extracted at the side of the side storage product entrance/exit portion 32 from the door storage 30. The side storage product entrance/exit portion 32 can be an opening through which the storage products are inserted/extracted into/from the door storage 30 at the side of the side storage product entrance/exit portion 32. The door storage 30 may have a box shape. The side storage product entrance/exit portion 32 may be located at one of the left and right sides of the door storage 30, which is more distant from the rotational center of the door 20. The side storage product entrance/exit portion 32 may have a gap with the inner wall of the storage room 2 when the door 20 is closed. The cooling air in the storage room 2 may flow into the door storage 30 through the side of the side storage product entrance/exit portion 32. The cooling air in the door storage 30 may flow out to the storage room 2 through the side of the side storage product entrance/exit portion 32. The side storage product entrance/exit portion 32 may be located at one of the left and right surfaces of the door storage 30. The side of the door storage 30, opposite to the side storage product entrance/exit portion 32, can be blocked. The rear surface of the door storage 30 can be blocked. The upper and lower surfaces of the door storage 30 can be blocked. A cooling air entrance/exit hole through which the cooling air in the storage room 2 is entered/exited may be defined in the door storage 30. The cooling air entrance/exit hole may be spaced apart from the side storage product entrance/exit portion 32. The door storage 30 may extend along the vertical direction. The height of the door storage 30 can be higher than that of the sub-storage 24. The lateral width of the door storage 30 can be shorter than that of the sub-storage 24. The door storage 30 can be mounted in a single or plural numbers to the door 20. A plurality of side storage product entrance/exit portions 32 can be formed in the door storage 30, and a support which allows the storage products to be put thereon while partitioning the inside of the door storage 30 into a plurality of storage spaces can be disposed inside the door storage 30. In a case where a plurality of storage spaces are formed inside the door storage 30, the side storage product entrance/exit portion 32 can be formed for each storage space. The door storage 30 can be mounted in plural numbers on the rear surface of the door 20. The plurality of door storages 30 can be mounted to be vertically spaced apart from one another.

As shown in FIGS. 4-6, the door locking mechanism 50 can include a moving locking member 51 mounted to the door 20 so as to be ascended/descended, a door latch 52 fixed and mounted to the door 20, and a locking member holder 54 locking the moving locking member 51 or releasing the locking of the moving locking member 51 when the door 20 is rotated to the acute opening angle. A holding groove portion 53 into which the moving locking member 51 is inserted to be held by the locking member holder 54 can be formed in the locking member holder 54.

An ascending/descending guide disposed to ascend/descend the moving locking member 51 can be formed in the door 20. The moving locking member 51 can be ascended or descended under the guidance of the ascending/descending guide.

The moving locking member 51 can include a striker held to the door latch 52 or of which locking is released, and a locking body locked to the locking member holder 54 or of which locking is released. The striker can be mounted to protrude to the locking body. The moving locking member 51 can have a gradient portion at one upper portion thereof. The gradient portion can be formed in the locking body.

The door latch 52 can have a holding mode in which the moving locking member 51 is descended to be held thereto. The door latch 52 can have a holding release mode in which the moving locking member 51 is ascended while releasing the holding of the moving locking member 51. The door latch 52 can include a latch casing mounted in the door 20. The door latch 52 can include a rotary member rotatably mounted in the latch casing. The rotary member can be mounted to restrict the moving locking member 51 in the holding mode of the door latch 52 and to upwardly push the moving locking member 51 in the holding release mode. The door latch 52 can include a spring elastically supporting the rotary member. The spring can elastically support the rotary member in the direction where the moving locking member 51 is pushed upward.

The holding groove portion 53 may be recessed at one side of the locking member holder 54. The holding groove portion 53 can be formed so that a portion of the moving locking member 51 is inserted into the holding groove portion 53 when the door 20 is positioned at the acute opening angle. When the door 20 is rotated in the door-close direction, the holding groove portion 53 can have a slope portion allowing the gradient portion of the moving locking member 51 to be guided therealong. When the door 20 is rotated in the door-close direction, the moving locking member 51 can be descended while the gradient portion overcomes the slope portion of the holding groove portion 53.

The locking member holder 54 can be mounted to always maintain a predetermined position regardless of the opening angle of the door 20. The door 20 can be rotatably connected to the hinge members 22 and 23 shown in FIG. 3. The locking member holder 54 can be fixed and mounted to one of the hinge members 22 and 23, or can be fixed and mounted to the main body 4. One of the hinge members 22 and 23 shown in FIG. 3 can include a main body fixing member 55 mounted to protrude from the main body 4 as shown in FIG. 5. The locking member holder 54 can be fixed and mounted to the main body fixing member 55, and the door 20 can be rotatably connected to the locking member holder 54. That is, the locking member holder 54 can constitute, together with the main body fixing member 55, one of the hinge members 22 and 23. The moving locking member 51 can be moved together with the door 20 when the door 20 is rotated, and the locking member holder 54 can be positioned on the moving trace of the moving locking member 51. In a case where the door latch 52 is in the holding release mode, the moving locking member 51 can be blocked by the locking member holder 54 so that the ascending of the moving locking member 51 in the upper direction is limited. The arbitrary separation of the moving locking member 51 in the upper direction can be limited.

If the door latch 52 is in the holding mode, the moving locking member 51 can descended toward the door latch 52 so as to be held to the door latch 52. When the door 20 is rotated, the moving locking member 51 can be moved along the rotational trace of the door 20. At this time, the moving locking member 51 can pass through a lower portion of the holding groove portion 52 while not being held to the holding groove portion 53.

If the door latch 52 is in the holding release mode, the moving locking member 51 can be ascended in the upper direction by the door latch 52. When the door 20 is rotated, the moving locking member 51 can be moved along the rotational trace of the door 20. When passing through the lower portion of the holding groove portion 53, at least a portion of the moving locking member 51 can be inserted into the holding groove portion 53 so as to be locked to the locking member holder 54. The moving locking member 51 can be held to the locking member holder 54 by entering into the holding groove portion 53 while being moved by the door 20. The door 20 is not rotated any more by the locking of the moving locking member 51 to the holding groove portion 53, and the current positions of the door 20 and the moving locking member 51 can be maintained. That is, the door 20 maintains the position at which the moving locking member 51 is locked to the holding groove portion 53. The door 20 is locked in the door-open direction.

The refrigerator can include a door-close maintaining mechanism 70 and 72 maintaining a door-close state of the door 20 or releasing the door-close state of the door 20, and a manipulation member 74 interlocked with the door manipulation portion 60 in the manipulation of the door manipulation portion 60 so as to release the closing of the door-close maintaining mechanism 70 and 72.

The door-close maintaining mechanism 70 and 72 can include a door locking member 70 fixed and mounted to the door 20, and a main body latch 72 mounted to the main body 4.

The door locking member 70 can be mounted to protrude backward from the rear surface of the door 20. The door locking member 70 can include a striker held to the main body latch 72 or of which holding is released. The door locking member 70 can include a fastening portion fastened to the door 20 by a fastening member, such as a screw.

The main body latch 72 holds the door locking member 70 or releases the holding of the door locking member 70. The main body latch 72 can include a latch casing mounted to the main body 4. The main body latch 72 can include a rotary member rotatably mounted in the latch casing. The rotary member can be mounted to restrict the door locking member 70 in the holding mode of the main body latch 72 and to push forward the door locking member 70 in the holding release mode of the main body latch 72. The main body latch 72 can include a spring elastically supporting the rotary member. The spring can elastically support the rotary member in the direction where the door locking member 70 is pushed forward. The main body latch 72 can have a press button 73 allowing the holding of the door locking member 70 to be released. If the press button 73 is not pressed, the main body latch 72 enables the door locking member 70 to be held thereto. If the press button 73 is pressed, the main body latch 72 enables the holding of the door locking member 70 to be released by pushing forward the door locking member 70. When being protruded forward from the main body latch 72, the press button 73 enables the rotary member to be rotated to the position at which the rotary member restricts the door locking member 70. When being pressed backward, the press button 73 enables the rotary member to be rotated to the position at which the door locking member 70 is pushed forward while releasing the holding of the rotary member to the door locking member 70.

The manipulation member 74 can be mounted in the door 20. The manipulation member 74 can be implemented as a power transmission member such as a Revana wire mounted in the door 20. The manipulation member 74 can be rotatably mounted in the door 20, and one side of the manipulation member 74 can be disposed to contact the door manipulation portion 60. When the door manipulation portion 60 is pressed, the manipulation member 74 can be rotated to press the press button 73. The manipulation member 74 can include a prominence 75 protruded backward from the rear surface of the door 20. The prominence 75 can press the press button 73.

The refrigerator can further include a door locking mechanism connecting member 76 allowing the mode of the door latch 52 to be changed into the holding release mode by being interlocked with the door manipulation portion 60 and connected to the door latch 52. A portion of the door locking mechanism connecting member 76 can be inserted into the door latch 52 so as to rotate the rotary member of the door latch 52. The door locking mechanism connecting member 76 can rotate the rotary member of the door latch 52 to the position at which the moving locking member 51 is pushed upward while releasing the holding of the rotary member to the moving locking member 51. The door locking mechanism connecting member 76 can include one or more levers 77 and 78 mounted in the door 20. The one or more levers 77 and 78 can be rotatably mounted in the door 20. The one or more levers 77 and 78 can include a driving lever 77 horizontally positioned inside the door 20 and rotatably connected to the door 20, and a driven lever 78 vertically positioned inside the door 20 and rotatably connected to the door 20. The driven lever 78 can be disposed to contact the driving lever 77. The driven lever 78 can be rotated by the driving lever 77 when the driving lever 77 is rotated. A portion of the driven lever 78 can be disposed to be inserted into the door latch 52. The driven lever 78 can be disposed to rotate the rotary member of the door latch 52. When the press button 73 is pressed by the manipulation of the door manipulation portion 60, the door locking mechanism connecting member 76 enables the mode of the door latch 52 to be changed into the holding release mode. When the closing of the door 20 is released by the manipulation member 74, the door locking mechanism connecting member 76 enables the mode of the door latch 52 to be changed into the holding release mode. The door locking mechanism connecting member 76 can be disposed to contact the door manipulation portion 60 or the manipulation member 74. If the user manipulates the door manipulation portion 60, the door locking mechanism connecting member 76 enables the mode of the door latch 52 to change into the holding release mode by the door manipulation portion 60 or the manipulation member 74. Simultaneously, the manipulation member 74 can press the press button 73.

The refrigerator can further include an auxiliary manipulation portion 80 mounted in the door 20, and an auxiliary manipulation member 82 interlocked with the auxiliary manipulation portion 80 in the manipulation of the auxiliary manipulation portion 80 so as to release the closing of the door-close maintaining mechanism 70 and 72.

The auxiliary manipulation portion 80 can be mounted at a position separate from that of the door manipulation portion 60. The auxiliary manipulation portion 80 can be mounted to one of the left and right sides of the door 20, which is more distant from the rotational center of the door 20. The auxiliary manipulation portion 80 can be disposed to be pressed by a recessed portion 81 formed in the door 20.

The auxiliary manipulation member 82 can be mounted in the door 20. The auxiliary manipulation member 82 can be implemented as a power transmission member such as a Revana wire mounted in the door 20. The auxiliary manipulation member 82 can be rotatably mounted in the door 20, and one side of the auxiliary manipulation member 82 can be disposed to contact the auxiliary manipulation portion 80. When the auxiliary manipulation portion 80 is pressed, the auxiliary manipulation member 82 can be rotated to press the press button 73. The auxiliary manipulation member 82 can include a prominence 83 protruded backward from the rear surface of the door 20. The prominence 83 can press the press button 73.

In the refrigerator, the press button 73 can be pressed in the manipulation of the door manipulation portion 60 or the auxiliary manipulation portion 80, and the door 20 can be rotated in the door-open direction while the main body latch 72 is pushing forward the door locking member 70.

In a case where the refrigerator includes the door-close maintaining mechanism 70 and 72, the door manipulation portion 60, the door locking mechanism connecting member 76 and the door locking mechanism 50 can perform a function of locking the door 20 at the acute opening angle, and the door manipulation portion 60, the manipulation member 74, the auxiliary manipulation portion 80 and the auxiliary manipulation member 82 can perform a function of releasing the door-close state of the door 20.

In the refrigerator, the door manipulation portion 60, the manipulation member 74, the door locking mechanism connecting portion 76 and the door locking mechanism 50 can constitute the door manipulation mechanism. The door manipulation mechanism can manipulate the door-close maintaining mechanism 70 and 72. In addition, the door manipulation mechanism can lock the door 20 at the acute opening angle where the side storage product entrance/exit portion 32 is exposed between the door 20 and the main body 4.

In the refrigerator, the door can be rotated in the door-open direction while releasing the door-close state of the door 20 in the manipulation of the door manipulation portion 60. At this time, the door locking mechanism 50 enables the door 20 to be locked at the acute opening angle. On the other hand, the door 20 can be rotated in the door-open direction while releasing the door-close state of the door 20 in the manipulation of the auxiliary manipulation portion 80. At this time, the door 20 can be rotated to the maximum opening angle.

The refrigerator may not include the door-close maintaining mechanism 70 and 72. In a case where the door-close maintaining mechanism 70 and 72 is not mounted in the door 20, the manipulation member 74 can be protruded toward the main body 4 in a state in which the manipulation member 74 is mounted in the door 20. The manipulation member 74 can apply an external force to the main body 4 by being protruded toward the main body 4 in the manipulation of the door manipulation portion 60. The door 20 can be rotated by the reaction of a force with which the manipulation member 74 pushes the main body 4. In a case where the door-close maintaining mechanism 70 and 72 is not mounted in the door 20, the auxiliary manipulation member 82 can be protruded toward the main body 4 in a state in which the auxiliary manipulation member 82 is mounted in the door 20. The auxiliary manipulation member 82 can apply an external force to the main body 4 by being protruded toward the main body 4 in the manipulation of the auxiliary manipulation portion 80. The door 20 can be rotated in the door-open direction by the reaction of a force with which the auxiliary manipulation member 82 pushes the main body 4.

Figure 7:
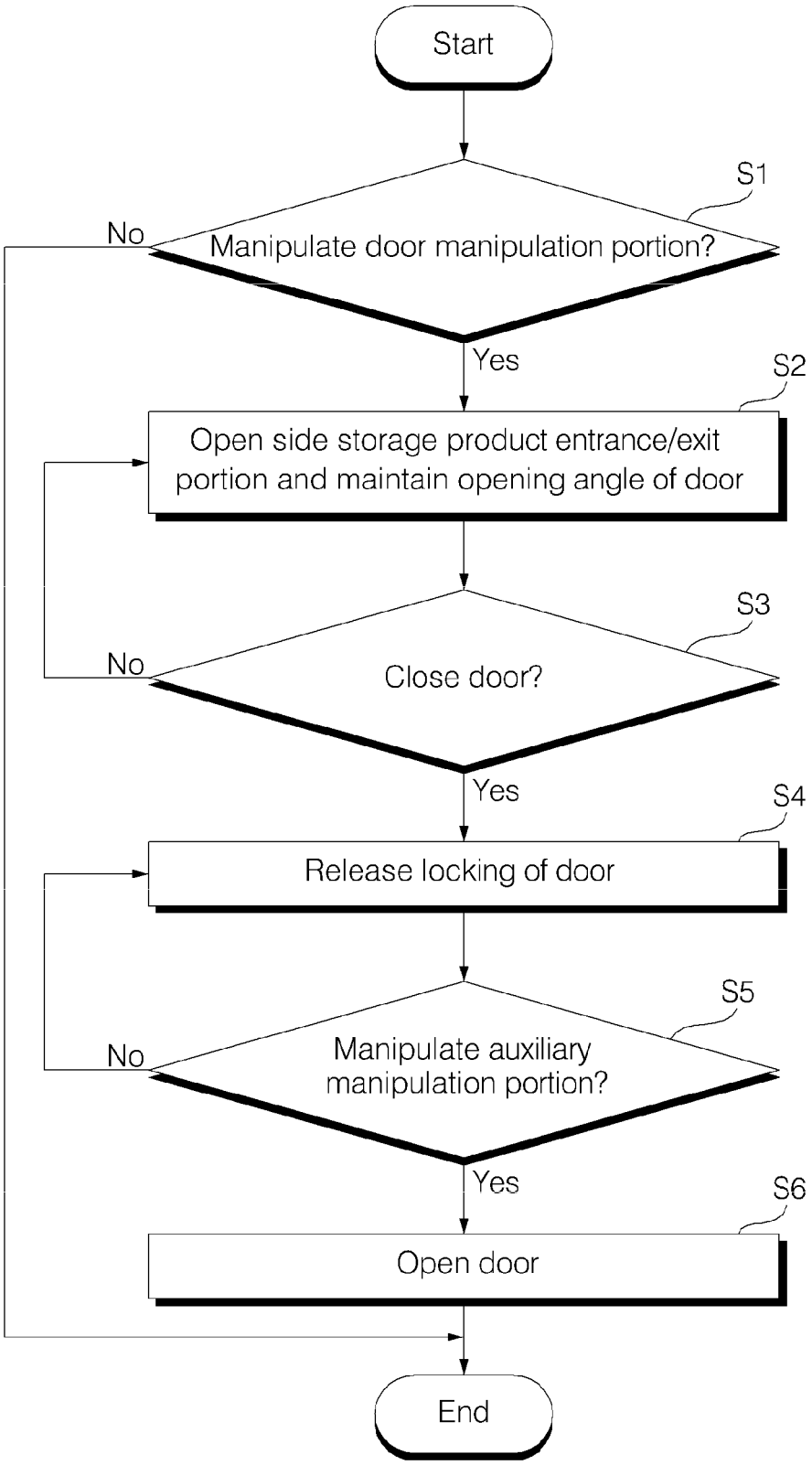
FIG. 7 is a flowchart illustrating an example process for opening/closing the door of the example refrigerator.

FIG. 7 illustrates an example process for opening/closing the door of the refrigerator. The process can include opening the side storage product entrance/exit portion (S1 and S2).

The opening of the side storage product entrance/exit portion (S1 and S2) can be performed when a user manipulates the door manipulation portion 60. The user can manipulate the door manipulation portion 60 when the door 20 is positioned to cover the front surface of the storage room 2. The user can manipulate the door manipulation portion 60 by pressing, pulling or rotating the door manipulation portion 60.

In the opening of the side storage product entrance/exit portion (S1 and S2), the door 20 can be locked at the opening angle where the side storage product entrance/exit portion 32 of the door storage 30 is opened, and the opening state of the side storage product entrance/exit portion 32 is maintained.

When the door manipulation portion 60 is manipulated, the door locking mechanism connecting member 76 can be interlocked with the door manipulation portion 60 so as to manipulate the door locking mechanism 50 in the locking mode. The door locking mechanism 50 enables the moving locking member 51 to be ascended while releasing the holding of the moving locking member 51 to the door latch 52. The moving locking member 51 can be moved by the door 20 while being ascended upward by the door latch 52.

When the door manipulation portion 60 is manipulated, the manipulation member 74 can release the closing of the door-close maintaining mechanism 70 and 72. The manipulation member 74 can press the press button 73 of the main body latch 72, and the main body latch 72 can push forward the door locking member 70 while releasing the holding of the door locking member 70. In the refrigerator, as the holding of the door locking member 70 is released by the main body latch 72, the door-close state of the door 20 can be released, and the door 20 can be rotated about the rotational center thereof.

The door 20 can be rotated in a state in which the moving locking member 51 is ascended, and the side storage product entrance/exit portion 32 of the door storage 30 is gradually exposed through the gap between the door 20 and the main body 4. When the door 20 is rotated, the moving locking member 51 can be moved to the lower portion of the holding groove portion 53 of the locking member holder 54. The moving locking member 51 can be inserted into the holding groove portion 53 of the locking member holder 54 by a force with which the moving locking member 51 is pushed upward. If the moving locking member 51 is inserted into the holding groove portion 53 of the locking member holder 54, the moving locking member 51 can be held to the locking member holder 54 so that the position of the moving locking member 51 is fixed. The door 20 is not rotated any more by fixing the position of the moving locking member 51, and the position of the door 20 is fixed. When the moving locking member 51 is inserted into the holding groove portion 53 of the locking member holder 54, the door 20 can be positioned at the acute opening angle where the side storage product entrance/exit portion 32 is entirely exposed between the door 20 and the main body 4, and the user can insert or extract storage products into/from the door storage 30 through the side storage product entrance/exit portion 32. The user can insert or extract storage products into/from the door storage 30 in a state in which the door 20 is not excessively opened. Thus, the refrigerator can minimize the leakage of cooling air between the door 20 and the main body 4.

The process can include releasing the locking of the door (S3 and S4) after the opening of the side storage product entrance/exit portion (S1 and S2).

Releasing the locking of the door (S3 and S4) can be performed by closing the door 20. If the user closes the door 20, the door 20 can be rotated in the opposite direction to that in the opening of the side storage product entrance/exit portion (S1 and S2). The moving locking member 51 which has been inserted into the holding groove portion 53 of the locking member holder 54 can be moved to the position except the lower portion of the holding groove portion 53 while climbing over the lower surface of the locking member holder 54, and held to the door latch 52. That is, the locking of the door locking mechanism 50 is released. As the rotation of the door 20 is continued, the door 20 is adhered closely to the main body 4. The door 20 is rotated to the position at which the door 20 covers the front surface of the storage room 2. When the door 20 is positioned to cover the front surface of the storage room 2, the door locking member 70 is held to the main body latch 72, and the door 20 is maintained in the door-close state thereof.

The process can include rotating the door to an opening angle greater than that in the opening of the side storage product entrance/exit portion (S5 and S6) after the releasing of the locking of the door (S3 and S4).

The user can manipulate the auxiliary manipulation portion 60 after the releasing of the locking of the door (S3 and S4). When the auxiliary manipulation portion 80 is manipulated, the auxiliary manipulation member 82 can release the closing of the door-close maintaining mechanism 70 and 72. The auxiliary manipulation member 82 can press the press button 73 of the main body latch 72, and the main body latch 72 can push forward the door locking member 70 while releasing the holding of the door locking member 70. In the refrigerator, as the holding of the door locking member 70 to the main body latch 72 is released, the closing state of the door locking member 70 can be released, and the door 20 can be rotated about the rotational center thereof. If the user rotates the door 20 while holding the door 20, the door 20 can be continuously rotated by passing through the position that is the opening angle of the door 20 in the opening of the side storage product entrance/exit portion (S1 and S2). The door 20 can be rotated to the position at which the rear surface of the door 20 is entirely exposed forward. The door 20 can be rotated up to the maximum opening angle, and the user can insert/extract the storage products into/from not only the door storage 30 but also the sub-storage 24 mounted to the door 20. The user can also insert/extract the storage products into/from the storage 8 of the storage room 2.

In the process, the closing of the door can be performed after the rotating of the door (S5 and S6). The user can rotate the door 20 in the opposite direction to the door-open direction while holding the door 20. The door 20 is adhered closely to the main body 4 and then rotated to cover the front surface of the storage room 2. When the door 20 is positioned to cover the front surface of the storage room 2, the door locking member 70 is held to the main body latch 72, and the door 20 can be again maintained in the door-close state thereof.

In the process, the closing of the door can be performed after the rotating of the door (S5 and S6), and the opening of the side storage product entrance/exit portion (S1 and S2) can be performed after the closing of the door.

Meanwhile, the process is not limited to the operations described above, and the opening of the side storage product entrance/exit portion (S1 and S2) can be performed by rotating the door 20 in the door-close direction of the door 20 while manipulating the door manipulation portion 60 after the rotating of the door (S5 and S6). The door 20 is rotated to an opening angle greater than the acute opening angle at which the door 20 is locked by the door locking mechanism 50, and then rotated to the acute opening angle at which the door is locked by the door locking mechanism 50. Thus, the door 20 can be fixed to the door locking mechanism 50. In the process, the releasing of the locking of the door (S3 and S4) can be performed after the opening of the side storage product entrance/exit portion (S1 and S2). That is, the rotating of the door (S5 and S6), the opening of the side storage product entrance/exit portion (S1 and S2), and the releasing of the locking of the door (S3 and S4) can be sequentially performed.

As described above, structure and operational examples have been described in detail with reference to appended drawings. However, the disclosure is not limited to the above and various modifications and implementations are possible. According to the refrigerator described above, storage products may be inserted/extracted into/from the door storage in the state in which the position of the door is fixed to the acute opening angle at which the side storage product entrance/exit portion is exposed. These features may make it possible to keep a large quantity of storage products in the door storage while minimizing the leakage of cooling air in the storage room.

Further, the door may be opened to an opening angle at which the side storage product entrance/exit portion is exposed through a user's convenient manipulation.

Further, storage products may be inserted/extracted into/from the door storage in the state in which the position of the door is fixed to the acute opening angle at which the side storage product entrance/exit portion is exposed. These features may make it unnecessary to insert/extract the storage products into/from the storage room in the state in which a user is holding the door. As such, user's convenience may be improved.

Further, the releasing of the door-close state of the door and the exposure of the side storage product entrance/exit portion may be simultaneously performed through a user's convenient manipulation, so that the manipulation of the refrigerator is convenient.

What is claimed is:

1. A refrigerator, comprising:

a main body;

a storage room defined in the main body;

a cooling device configured to cool the storage room;

a door rotatably connected to the main body and configured to open and close the storage room;

a door storage unit mounted to the door and having a side storage portion that is accessible when the door is open to an acute opening angle;

a door locking mechanism configured to selectively lock the door at the acute opening angle at which the side storage portion is exposed between the main body and the door; and a door manipulation portion configured to manipulate a locking mode of the door locking mechanism, wherein the door locking mechanism comprises:

a moving locking member mounted in the door and configured to move upward and downward;

a door latch mounted in the door, configured to latch the moving locking member based on the moving locking member being moved downward to a descended position, and configured to release the moving locking member based on the moving locking member being moved upward to an ascended position; and a locking member holder having a holding groove portion, wherein the locking moving member is configured to insert into the holding groove portion and be held to the door latch based on the door being rotated to the acute opening angle.

2. The refrigerator of claim 1, wherein the side storage portion is an opening in the door storage unit that extends in a lateral direction of the door.

3. The refrigerator of claim 1, wherein the side storage portion is located at a side of the door storage unit.

4. The refrigerator of claim 1, wherein the side storage portion is located at a side of the door storage unit, which is furthest from a rotational center of the door.

5. The refrigerator of claim 1, wherein the side storage portion has an inner wall and, when the door is closed, a gap enables air from the storage room to enter the side storage portion past the inner wall.

6. The refrigerator of claim 1, wherein the side storage portion has an opening at a first side and is blocked at a second side opposite to the first side.

7. The refrigerator of claim 1, wherein the door storage unit extends in the vertical direction.

8. The refrigerator of claim 1, wherein the door storage unit comprises multiple side storage portions.

9. The refrigerator of claim 1, wherein the acute opening angle is within a range from 10 to 30 degrees.

10. The refrigerator of claim 1, wherein the acute opening angle is an opening angle at which the side storage portion is entirely exposed.

11. The refrigerator of claim 1, wherein the acute opening angle corresponds to a lateral width of the side storage portion.

12. The refrigerator of claim 1, further comprising a connecting member that is linked with the door manipulation portion, that is connected to the door latch, and that is configured to release the door latch from the moving locking member.

13. The refrigerator of claim 1, comprising:

a maintaining mechanism configured to maintain a closed state of the door and release the closed state of the door; and a manipulation member that is linked with the door manipulation portion and configured to release the closed state of the door maintained by the maintaining mechanism based on the door manipulation portion being manipulated.

14. The refrigerator of claim 13, further comprising:

an auxiliary manipulation portion mounted in the door; and an auxiliary manipulation member that is linked with the auxiliary manipulation portion and that is configured to release the closed state of the door maintained by the maintaining mechanism based on the auxiliary manipulation portion being manipulated.

* * * * *